US006629839B2

(12) United States Patent
Ozawa et al.

(10) Patent No.: US 6,629,839 B2
(45) Date of Patent: Oct. 7, 2003

(54) METHOD AND APPARATUS FOR CHARGING RAW AND CARBONACEOUS MATERIALS INTO A MOVING HEARTH FURNACE

(75) Inventors: Tatsuya Ozawa, Chiba (JP); Tetsuya Yamamoto, Okayama (JP); Yoshitaka Sawa, Chiba (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/917,106

(22) Filed: Jul. 27, 2001

(65) Prior Publication Data

US 2002/0022208 A1 Feb. 21, 2002

(30) Foreign Application Priority Data

Aug. 7, 2000 (JP) ..... 2000-238805

(51) Int. Cl.[7] ..... F27B 9/16
(52) U.S. Cl. ..... 432/195; 432/138; 75/477
(58) Field of Search ..... 432/103, 105, 432/109, 138, 195, 201; 414/160, 162; 201/87; 266/173; 110/233, 247; 75/474, 477, 487

(56) References Cited

U.S. PATENT DOCUMENTS 2,676,006 A * 4/1954 Martin ..... 432/138
3,947,621 A 3/1976 Collin et al.
6,273,932 B1 * 8/2001 Sherwood ..... 75/477

FOREIGN PATENT DOCUMENTS

EP 1 026 265 A1 8/2000
WO WO 98/46953 10/1998

* cited by examiner

*Primary Examiner*—Gregory Wilson
(74) *Attorney, Agent, or Firm*—Piper Rudnick LLP

(57) ABSTRACT

The invention provides a method and apparatus for charging a raw material and a carbonaceous material, in which a reduced product generated on a hearth can be quickly melted for reliable separation into a metal and slag, and the metal and the slag can be easily discharged out of a furnace as individual small agglomerates. With the charging method and apparatus, when charging the raw material and the carbonaceous material onto the moving hearth of the moving hearth furnace, the carbonaceous material is first charged onto the moving hearth to form a carbonaceous material layer thereon. The raw material or a mixture of the raw material and a carbonaceous material is then charged onto the carbonaceous material layer to form a raw material layer thereon. A projection is then pressed against the raw material layer from above, thereby forming a plurality of recesses in the surface of the carbonaceous material layer.

14 Claims, 3 Drawing Sheets

METHOD AND APPARATUS FOR CHARGING RAW AND CARBONACEOUS MATERIALS INTO A MOVING HEARTH FURNACE

BACKGROUND OF THE INVENTION

1. Field of the Invention

This invention relates to a technique for charging raw materials, carbonaceous materials, and the like into a moving hearth furnace. More particularly, this invention relates to a material charging method and apparatus for use in a moving hearth furnace wherein raw materials comprising metal-containing materials such as ores containing metals, e.g., Fe, Cr and Ni, iron manufacturing dust and sludge, and industrial wastes (collectively sometimes hereinafter referred to as a "raw material"), are charged/deposited on a moving hearth along with carbonaceous materials comprising solid reductants such as coal, coal char, and coke (collectively sometimes hereinafter referred to as a "carbonaceous material"), and then the deposited raw material is heated for reduction and melting during movement of the moving hearth within a heating furnace, thereby recovering reduced metals continuously. The method and apparatus of the invention reliably and easily performs production, separation and discharge of reduced metals after melting.

2. Description of the Related Art

A reduced metal, e.g., steel, is generally produced by a converter or an electric furnace. According to the process using an electric furnace, scrap and reduced iron are melted under heating with electric energy and then refined, if necessary, for production of steel. Recently, however, there is a tendency to employ reduced iron instead of scrap because of a stringent relation between demand and supply of scrap and an increasing demand for higher quality steel.

As one of the processes for producing reduced iron, etc., the so-called "moving hearth furnace" is known in which an iron ore and a solid reductant are charged/deposited on a horizontally moving hearth, and the iron ore is heated for reduction by radiant heating from above, thereby producing reduced iron (Japanese Unexamined Patent Publication No. 63-108188). The moving hearth furnace used in the above known process is of the type that the charged and deposited raw material is heated during horizontal movement of a hearth within a heating furnace. Usually, the horizontally moving hearth is constructed to move along a ring-shaped locus (i.e., to make a revolution) as shown in FIG. 1.

A rotary hearth furnace will be described below as one example of moving hearth furnaces.

As shown in FIG. 1, a conventional rotary hearth furnace has a ring-shaped furnace body 10 partitioned into a preheating zone 10*a*, a reducing zone 10*b* and a cooling zone 10*d*, which are arranged in that order from the supply side of raw materials toward the discharge side. Within the furnace body 10, a ring-shaped moving hearth 11 is disposed to be able to rotate. A mixture of a raw material, e.g., iron ore, and a carbonaceous material serving as a solid reductant is charged onto the moving hearth 11 under rotation.

It is to be noted that raw material pellets including carbonaceous materials therein are suitably used as the mixture of both the materials. A refractory is placed on the surface of the hearth 11, but a particulate refractory, for example, may be laid on the hearth surface. Burners 13 are disposed in an upper portion of the furnace body 10. By using the burners 13 as heat sources, metal-containing oxides, such as iron ores, deposited on the moving hearth 11 are heated for reduction in the presence of reductant, thereby obtaining reduced iron. Additionally, in FIG. 1, numeral 14 denotes a charging apparatus for charging the raw material onto the hearth, and numeral 15 denotes a discharging apparatus for discharging the reduced material.

Meanwhile, general metal-containing materials, e.g., iron ores, contain many gangue components which are different depending on the places of their production, whereas coal, coal char, and coke as typical solid reductants also contain ashes. In the moving hearth furnace, gangues are unavoidably mixed in the reduced iron having been produced, and ashes contained in the reductants also remain affixed to the reduced iron. This has imposed restrictions that only those raw materials and solid reductants having high-grade quality must be employed in the moving hearth furnace.

Further, if reduced iron containing gangues and ash in large amounts is introduced as a raw material to an electric furnace, the amount of lime to be used for adjustment of the basicity of slag must be increased in the operation of the electric furnace. This necessarily increases not only the cost due to an increase in the amount of lime used, but also the amount of consumed energy, e.g., electric power, due to an increase in the amount of heat required for removing the lime in the form of slag. From that point of view, it has also been essential in the operation of a conventional moving hearth furnace to use only high-grade iron ores containing gangue components as small as possible, and to use reductants containing ashes in smaller amount.

Recently, however, the use of lower-grade materials has been obliged due to exhaustion of resources, such as iron ore and coal, and changes in properties thereof. Thus, this situation has created a problem to be solved as quickly as possible.

Because of those reasons including the necessity of using higher-grade raw materials and carbonaceous materials, there has been a need for development of techniques capable of effectively separating metal components and gangue and other unnecessary components from each other. For example, one method for separating metal components and gangue and other unnecessary components is melting separation of gangues and ash from reduced iron, the separated gangues and ash being treated to turn to slag for removal.

Melting reduced iron on the hearth, however, causes the problem that the melted metal adheres by fusion to the hearth refractory or enters fine cracks or the like and, hence, damages the hearth refractory when the solidified metal is discharged. In particular, because the interior of the moving hearth furnace is subjected to fairly high temperatures for ore reduction, an expensive refractory capable of enduring high temperatures is employed to form the hearth. From the viewpoint of suppressing the production cost of products, therefore, due consideration must be paid so that the hearth refractory will not be damaged for a long period of time.

To overcome the above-mentioned problems, the assignee of this application proposed, in Japanese Unexamined Patent Publication No. 11-106815, "A method of operating a moving hearth furnace, in which a raw material mainly consisting of a powdery iron ore and a powdery solid reductant is deposited on a horizontally moving hearth to form a layer, and the iron ore is reduced by radiant heating from above within the furnace, the method comprising the steps of depositing a powder mixture of the powdery iron ore and the powdery solid reductant, or a powder mixture of the powdery iron ore, a powdery assistant raw material and the powdery solid reductant on the hearth in the form of scattered small divisions such that the powdery mixture will not be brought into direct contact with the hearth by the presence of the powdery solid reductant therebetween, and then melting reduced iron on the hearth at least once." With those features, the proposed method is intended to "produce reduced iron containing neither gangues nor ash mixed therein, i.e., reduced iron highly suitably used in an electric furnace, while employing a simple installation and ensuring smooth operation without damaging the installation".

However, Japanese Unexamined Patent Publication No. 11-106815 does not specifically describe a method for charging the raw material in the form of small divisions scattered in the carbonaceous material as illustrated in FIGS. 3, 5, 6 and 7 thereof. An intricate process is used to achieve the method for properly charging the raw material in each recess of the carbonaceous material such that the raw material will not come out from the recess and will be kept from mixing with the raw materials charged in the adjacent divisions. The apparatus for charging the raw material is also necessarily complicated. The proposed methods are, therefore, not yet sufficient for practical use in actual operation.

SUMMARY OF THE INVENTION

Accordingly, it is a primary object of the invention to provide a method and apparatus for charging a raw material or the like in which a reduced product generated on a hearth can be quickly melted to form small agglomerates with certainty while avoiding the resulting metal and slag to become oversized and, hence, the reduced product can be easily discharged out of a furnace as individual pieces of the small agglomerates.

Another object of the present invention is to establish a technique for producing a reduced metal in a simple manner, while achieving high productivity, without needing any preliminary process for treating raw materials, such as pelletizing them as practiced in the related art.

As a result of conducting studies with the view of realizing the above objects, the inventors have succeeded in accomplishing this invention.

According to one aspect of the invention, there is provided a method of charging a raw material and a carbonaceous material into a moving hearth furnace in which a raw material mainly comprising a powdery and/or granular metal-containing material and a carbonaceous material comprising a powdery and/or granular solid reductant are charged onto a moving hearth to lie deposited thereon, and the raw material is heated for reduction and melting during movement of the moving hearth within a heating furnace, thereby producing a reduced metal, wherein charging the raw material and the carbonaceous material onto the moving hearth comprises the steps of charging the carbonaceous material onto the moving hearth to form a carbonaceous material layer thereon; charging the raw material or a mixture of the raw material and a carbonaceous material onto the carbonaceous material layer to form a raw material layer thereon; and pressing a projection against the raw material layer from above, thereby forming a plurality of recesses on the surface of the carbonaceous material layer.

Preferably, in the step of pressing a projection against the raw material layer from above, a tip end of the projection is depressed to a level lower than a surface level of the carbonaceous material layer, thereby forming a recess that sinks from the raw material layer into the carbonaceous material layer.

Also, preferably, a portion of the raw material layer corresponding to the recess to be formed in the surface of the carbonaceous material layer is depressed at the same time as or before the pressing of the projection.

Further, in the above charging method, the projection pressing step is preferably performed using a denting roll provided with a plurality of projections.

Still further, in the above charging method, before pressing the projection of the denting roll, the raw material layer is preferably depressed in advance by an outer circumferential portion of the denting roll other than the projections.

According to another aspect of the present invention, there is provided an apparatus for charging a raw material and a carbonaceous material into a moving hearth furnace in which a raw material mainly comprising a powdery and/or granular metal-containing material and a carbonaceous material comprising a powdery and/or granular solid reductant are charged onto a moving hearth to lie deposited thereon, and the raw material is heated for reduction and melting during movement of the moving hearth within a heating furnace, thereby producing a reduced metal, wherein the apparatus for charging the raw material and the carbonaceous material onto the moving hearth comprises a carbonaceous material charging unit for charging the carbonaceous material onto the moving hearth to form a carbonaceous material layer; a raw material charging unit for charging the raw material or a mixture of the raw material and a carbonaceous material onto the carbonaceous material layer formed on the moving hearth to form a raw material layer thereon; and a denting device for pressing a projection against the raw material layer from above, thereby forming a plurality of recesses on the surface of the carbonaceous material layer lying under the raw material layer, the denting device being provided downstream of the raw material charging unit in the direction of movement of the moving hearth.

Also, in the above charging apparatus, the denting device is preferably a denting roll provided with a plurality of projections.

DESCRIPTION OF THE PREFERRED EMBODIMENTS

Figure 1:
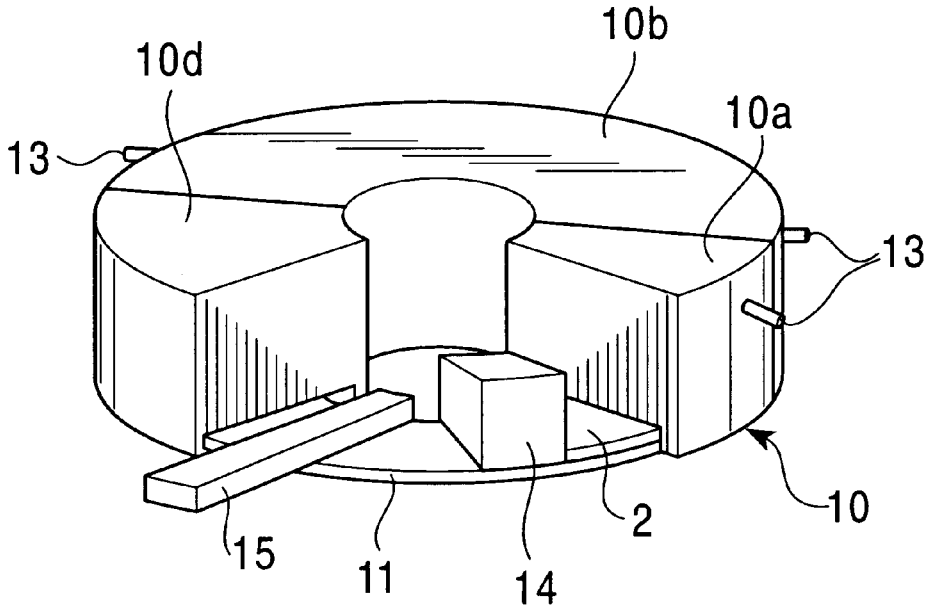
FIG. 1 is a schematic view of a known moving hearth furnace.

It will be appreciated that the following description is intended to refer to specific embodiments of the invention selected for illustration in the drawings and is not intended to define or limit the invention, other than in the appended claims.

In a preferred embodiment of the invention, a solid reductant, e.g., a carbonaceous material, is charged to lie deposited on a moving hearth to form a layer of the carbonaceous material, and a raw material or a mixture of a raw material and a carbonaceous material is deposited on the carbonaceous material layer to form a raw material layer on it. Even in a condition where the raw material (such as a metal-containing material) deposited, as an overlying layer, on the carbonaceous material layer is melted, the carbonaceous material layer deposited, as an underlying layer, on the moving hearth is not melted and both the materials will not mix with each other. This is because, until the raw material is melted, most of the carbonaceous material does not yet essentially function as a reductant and is not substantially changed except for the so-called "volatile" component being lost. Incidentally, a general solid reductant typically contains about 10 wt % of ash and the balance of primarily a carbonaceous material and, hence, it maintains a solid state at high temperatures on the order of about 1000 to about 1500° C.

Thus, an advantageous feature of the invention is that, in spite of the overlying raw material layer being melted, a melted product of the raw material can be prevented from coming into direct contact with the hearth by the presence of the underlying carbonaceous material layer. Stated otherwise, the carbonaceous material layer serves as a refractory protective layer. Further, after the raw material (such as a metal-containing material) deposited on the carbonaceous material layer has melted, the reduction reaction proceeds quickly with the carbonaceous material functioning also as a reductant, because the contact area between the metal-containing material having melted and the carbonaceous material in the underlying carbonaceous material layer is increased.

Another advantageous feature of the invention is that, after charging the raw material to lie deposited on the carbonaceous material layer, a recess is formed not only in the raw material layer, but also in the surface of the carbonaceous material layer. In other words, a projection is pressed against the raw material layer from above so that a recess is formed to depress the raw material layer and to sink into the carbonaceous material layer at the same time.

Generally, metal and slag produced upon melting occurs with the progress of the reduction reaction, which tends to aggregate under the action of gravity and surface tension of the melted material itself. By forming a recess in the carbonaceous material layer, therefore, the melted metal and the melted slag tend to aggregate in the recess. Also, by forming a number of recesses in the carbonaceous material layer in a scattered pattern, agglomerates of the melted metal, etc. are maintained in the form of scattered spots. In this connection, since the volume of each of the melted metal and the melted slag contracts to about 10–60% of the original volume of the raw material or the mixed raw material, the melted metal and the melted slag are separated into the recesses.

The melted metal and the melted slag each have the specific gravity greater than the carbonaceous material, and this means that they may enter below the carbonaceous material layer. In fact, however, the melted material turns to the granular form due to surface tension developed by itself and is held on the carbonaceous material layer as scattered granules, which remain received in the recesses.

Accordingly, when the melted metal and the melted slag are cooled in a cooling zone on the moving hearth, the metal and the slag, in which gangues and ash are separated, are held as agglomerates in each of the recesses formed in the surface of the carbonaceous layer. Further, since the solidified metal and slag are kept away from the hearth by the presence of the carbonaceous layer, they avoid adhering by fusion to the hearth or damaging it, and are held in the form of small agglomerates. As a natural consequence, the solidified metal and slag can be easily discharged out of the furnace.

On other hand, if the surface of the carbonaceous material layer remains flat, the melted metal and the melted slag are held on the carbonaceous material layer and, hence, will not damage the refractory of the hearth. However, the metal and the slag after being cooled are not present on the carbonaceous material layer in the form divided into small-scattered agglomerates. In many cases, the metal and the slag are continuously joined to form a large agglomerate. This often results in difficulties discharging the metal from the furnace.

Additionally, the metal and the slag discharged from the furnace hearth are separately recovered outside the furnace, for example, by utilizing magnetic forces to separate a ferromagnetic metal from the slag, or by winnowing or the like utilizing wind (air) to separate the metal and the slag based on a density difference between them.

In the invention, the above-mentioned recesses are formed on the surface of the underlying carbonaceous material layer by a method described below.

Figure 2:
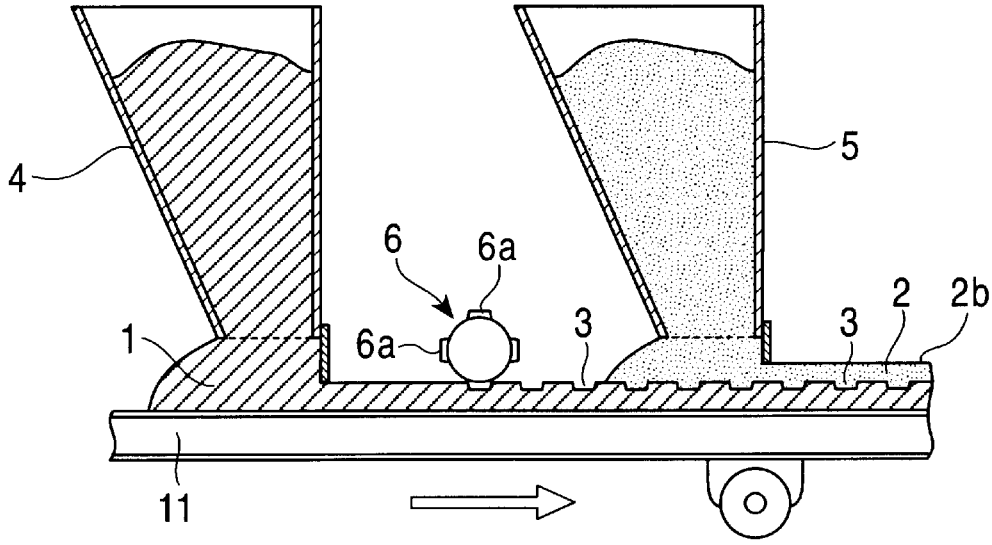
FIG. 2 is a schematic view of a charging apparatus as a comparative example.

FIG. 2 shows, as a comparative example, one design of a charging apparatus 14, which has been first studied by the inventors for forming recesses 3 in an underlying carbonaceous material layer 1. (Since the arrangements shown in FIG. 2 were uniquely developed by the inventors herein prior to accomplishing the invention and has not been known to the public in any way before Aug. 7, 2001 of prior date of this invention, it does not constitute the known related art regarding this invention.)

Referring to FIG. 2 and the charging apparatus 14, a carbonaceous material hopper 4 and a raw material hopper 5 are disposed above a moving hearth 11, which is moved at a speed in the range of about 20 to about 160 mm/sec, along the direction of movement of the hearth 11. A denting roll 6 is disposed between the two hoppers 4, 5.

Carbonaceous material dispensed from the carbonaceous material hopper 4 is first deposited on the moving hearth 11 to form a carbonaceous material layer 1 with a thickness of about 50 mm. Then, a denting roll 6 provided with a plurality of projections 6*a* (having a height of about 13 mm) projected on a barrel circumferential surface and having a shape corresponding to the recess 3 to be formed is rotated to press the projection 6*a* against the surface of the carbonaceous material layer 1, thereby forming the recess 3.

Subsequently, raw material mainly comprising a metal-containing material is dispensed from the raw material hopper 5 and deposited to form a raw material layer 2 with a thickness of about 10 to about 25 mm on the surface of the carbonaceous material layer 1 in which the recesses 3 have been formed. Thereafter, the carbonaceous material layer 1 and the raw material layer 2 are fed to the preheating zone 10*a* of the hearth furnace 10.

In the comparative example of the charging apparatus 14 described above, after the recesses 3 have been formed in the carbonaceous material layer 1, the raw material is dispensed and deposited on the surface of the carbonaceous material layer 1 including the recesses 3. Therefore, the shape of each recess 3 tends to give away due to shocks caused upon the raw material being deposited, thus resulting in a low aggregation rate of the melted materials (metal and slag) and poor demarcation in scattering of the individual agglomerates. Another problem is that, because the upper surface 2*b* of the raw material layer 2 heated in the hearth furnace is flat, the raw material in the recess 3 tends to be delayed in melting.

Figure 3:
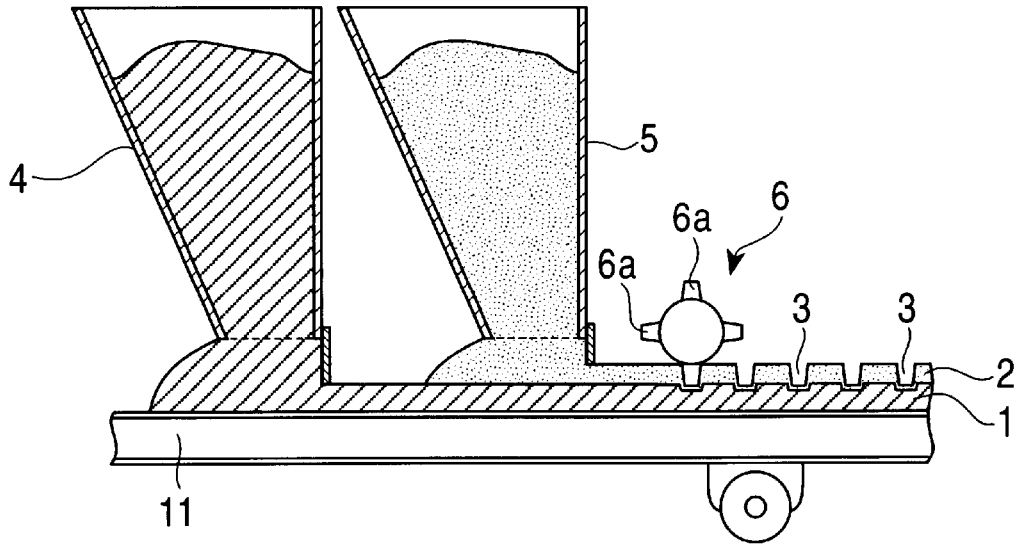
FIG. 3 is a schematic view of a charging apparatus according to the invention.

For overcoming the above-mentioned problems with the comparative example of the charging apparatus, the invention utilizes a charging apparatus shown in FIG. 3 and a charging method for use with the charging apparatus.

In a charging apparatus 14 according to the invention, a carbonaceous material hopper 4 is disposed above a moving hearth 11, which is moved at a speed in the range of about 20 to about 160 mm/sec, along the direction of movement of the hearth 11. A raw material hopper 5 is disposed on downstream of the carbonaceous material hopper 4. Further, downstream of the raw material hopper 5, a denting roll 6 is disposed which has a plurality of projections 6*a* having a height of about 23 mm and projected on a barrel circumferential surface. With the charging apparatus 14 thus constructed, a carbonaceous material dispensed from the carbonaceous material hopper 4 is first deposited on the moving hearth 11 to form a carbonaceous material layer 1 with a thickness of about 50 mm. Then, a raw material mainly comprising a metal-containing material is dispensed from the raw material hopper 5 and deposited on the carbonaceous material layer 1 to form a raw material layer 2 with a thickness of about 10 to about 25 mm. Subsequently, the projection 6*a* of the denting roll 6 is pressed against the surface of the raw material layer 2 from above, whereby the raw material layer 2 is itself depressed to form a recess (dent) 3 that extends into the carbonaceous material layer 1.

Figure 4:
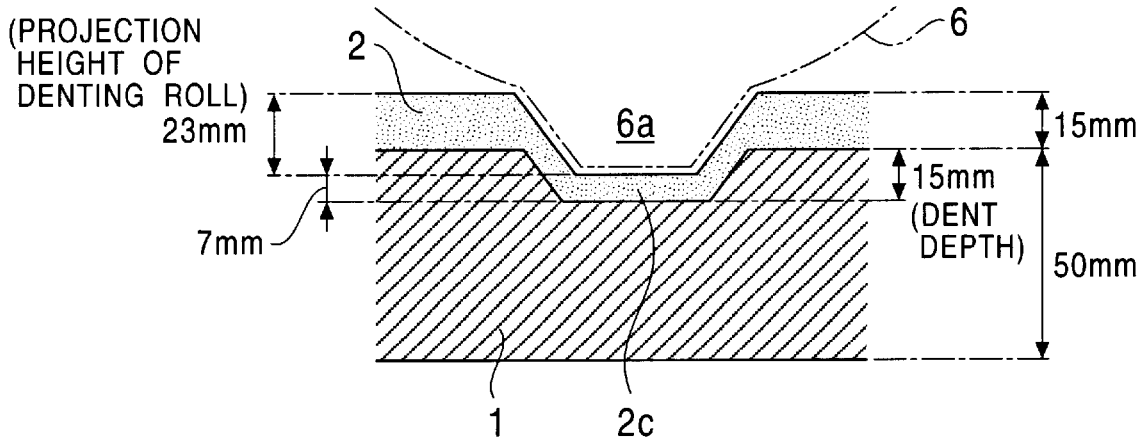
FIG. 4 is an enlarged sectional view showing in detail a recess formed according to the invention, including the surroundings of the recess.

More specifically, the recess 3 is formed as shown in FIG. 4. For example, when the initial thickness of the raw material layer 2 is about 15 mm, the raw material layer 2 in the recess 3 is compressed to a thickness of about 7 mm, and the bottom of the formed recess 3 (lower end of a depressed portion 2*c* of the raw material layer 2) is positioned at a level recessed about 15 mm from the surface of the carbonaceous material layer 1. Thus, the recess 3 is formed such that the depressed portion 2*c* of the raw material layer 2, which has been compressed to the thickness of about 7 mm, is entirely buried in the carbonaceous material layer 1.

Since the recess 3 has the above-described structure, i.e., since the depressed portion 2*c* of the raw material layer 2 is entirely buried in the carbonaceous material layer 1, the melted metal more easily aggregates in the recesses 3 and is scattered with more definite demarcation.

Further, the presence of the recesses 3 formed in the surface of the raw material layer heated in the hearth furnace increases the area receiving heat and accelerates heat transmission to the raw material layer, thereby improving productivity. Additionally, since the recesses 3 are formed in a final stage of the process for charging the raw material, the shape of each recess is retained and does not give way. As a result, agglomeration of the metal and the slag can be realized with for greater certainty, and no troubles are caused in discharging the agglomerated metal and slag.

To more effectively develop the above-described action of the charging apparatus 14 of the invention, it is preferred to, before performing the denting step, press the surface of the raw material layer 2 around the recess 3 so that the raw material layer 2 is compressed in such an area for compaction. With this preliminary compacting step, the shape of the recess 3 is less likely to give way in the denting step, and the recess having a desired shape can be definitely formed and surely maintained. As a means for compacting the raw material layer, a roll or a press for compaction (not shown) may be installed upstream of the denting roll. As an alternative, an outer circumferential portion of the denting roll other than the projections may be used to compact the raw material layer in advance.

Instead of the denting roller, any other suitable means are also available for forming the recess, which include, for example, a stamp having a projection or a rod having a predetermined shape, the stamp or rod being pressed against the surface of the raw material layer from above. In the case of employing a stamp having a projection, the denting step and the step of compacting the raw material layer can be both carried out at the same time.

In the invention, the metal-containing material contained in the raw material may be, for example, powder and/or granules containing metals such as iron, Ni, Cr, Zn and Pb, including an iron ore, a Cr ore, a Ni ore, sand iron, reduced iron powder, iron manufacturing dust, stainless refining dust, and iron manufacturing sludge.

On the other hand, the solid reductant, i.e., the carbonaceous material, may be primarily powder of a carbon containing material such as coal char, coke, general coal, and smokeless coal. The powdery and/or granular raw material and the powdery and/or granular carbonaceous material may be used in the single phase of one type or in the mixed phase of two or more types for each material. Desirably selected ones of those metal-containing materials and solid reductants are charged into the hearth furnace in a combined fashion as described above.

When employing the metal-containing material, which contains a sufficient amount of carbon in itself, as with iron manufacturing dust and sludge among the above-listed raw materials, it may be used alone without being mixed with the carbonaceous material. Also, a supplemental raw material may be added to the raw material in the least necessary amount for rendering the reduced iron and ash to melt more easily in the melting step. Examples of such a supplemental raw material include limestone, fluorite, serpentine, and dolomite. The supplemental raw material may be used in the agglomerated form, e.g., briquettes and pellets.

EXAMPLE

In this Example, an experiment of cold depositing (charging) the carbonaceous material and the raw material under conditions in accordance with the invention was conducted using an experimental material charging apparatus for confirmation of the advantageous effect of the invention.

Coke comprising 100% granules having sizes of not greater than 10 mm in terms of minus mesh, i.e., downstream of screening, was deposited on the moving hearth 11 to form the carbonaceous material layer 1 with an average thickness of 50 mm. On the carbonaceous material layer 1, a raw material was deposited to form the raw material layer 2 with an average thickness of about 15 mm, the raw material containing an ore comprising 100% granules having sizes of not greater than 3 mm in terms of minus mesh, i.e., downstream of screening, and coke comprising 100% granules having diameters of not greater than 10 mm in terms of minus mesh, i.e., downstream of screening, which were mixed at a ratio of 80:20 by weight. Then, by using the denting roll 6 provided with the plurality of projections 6*a*, a number of recesses (dents) 3 were formed on the surface of the raw material layer 2 with such a depth that each recess sank from the surface level of the raw material layer 2 to a level recessed in the carbonaceous material layer 1. The denting roll 6 used in this Example had a diameter of 100 mm and a projection height of 23 mm, but the configuration of the denting roll 6 is not limited to those dimensions.

It was however confirmed that, preferably, the denting roll 6 has a greater diameter and the height of the projection 6*a* was selected to provide an about 15-mm depth of the dent (level difference between the original surface and the depressed surface of the carbonaceous material layer) which remains finally in the surface the carbonaceous material layer, although depending on the bulk densities of the deposited raw material and the carbonaceous material.

Further, the circumferential speed of the denting roll is preferably equal to or lower than the travel speed of the moving hearth 11. The reason is that, if the roll circumferential speed is too high, the roll projection tends to destroy the inner wall of the recess, and the recess having a desired shape cannot be formed with certainty.

Figure 5:
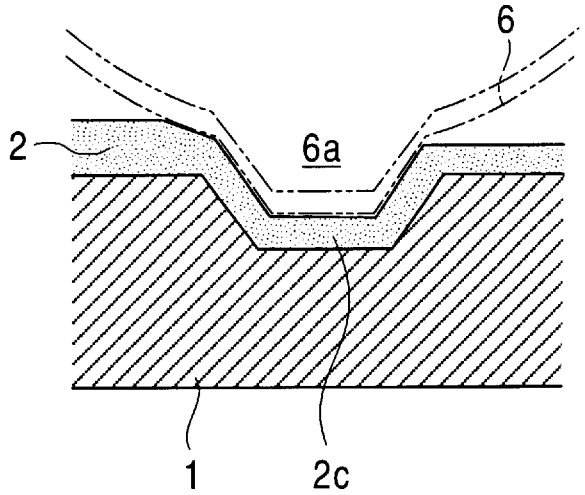
FIG. 5 is an enlarged sectional view showing in detail a recess formed according to the invention, including the surroundings of the recess.

It was also confirmed that, by lowering the vertical position of the denting roll 6 as shown in FIG. 5 in the denting step, the raw material layer could be depressed in advance by the outer circumferential portion of the denting roll other than the projections, whereby the recess could be prevented from giving way in the denting step and, hence, the recess having a desired shape could be formed with higher certainty.

As a result of depositing the carbonaceous material and the raw material as described above, the depth of the recess (depth) 3 which remained finally in the surface the carbonaceous material layer was a satisfactory value of 15 mm in average. By heating the deposited materials in a heating furnace from above the surface of the raw material layer 2, a reduced material in the metal-containing material was melted and aggregated in the recesses 3 remaining in the carbonaceous material layer 1 while developing separation into a metal and slag. Consequently, the intended object was achieved.

With the charging method of this Example, the intended object can be achieved so long as the granule size of the carbonaceous material forming the carbonaceous material layer is about 10 mm or less in terms of minus mesh, i.e., downstream of screening, and the metal-containing material forming the overlying layer also has a granule size comparable to that of the carbonaceous material forming the carbonaceous material layer regardless of whether the metal-containing material is mixed with the carbonaceous material. It was confirmed that metal-containing dust, e.g., blast furnace dust, could be used as one example of such a metal-containing material.

As described above, according to the invention, a number of recesses are formed in a scattered pattern by projections of a denting roll with such a depth that the recess sinks from the surface of an overlying raw material layer into an underlying carbonaceous material layer. Under heating from above the surface layer, therefore, a metal-containing material is heated for reduction and melting, whereby the reduced metal-containing material is caused to easily aggregate in the recesses formed in the carbonaceous material layer due to the actions of gravity and surface tension of the melted material itself, while developing separation into a metal and slag. Hence, the solidified granular metal and slag can be produced in the scattered recesses. Additionally, according to the invention, since the denting step to form the recess is performed as a final stage in a series of material charging steps, the formed recess is prevented from giving way in subsequent steps, and the metal and the slag can aggregate into the recesses with greater certainty.

Further, since the presence of the recesses in the surface of the raw material layer increases the surface area subjected to heating, it is possible to accelerate the heat transmission, prevent delays in reduction and melting, and improve productivity. Particularly, since the melted metal and the melted slag are more certainly aggregated into the recesses in the agglomerated form, they can be not only easily discharged from the moving hearth, but also easily classified from the carbonaceous material layer which forms the carbonaceous material layer and is discharged out together with the melted metal and the melted slag, thus resulting in a very high yield.

Also, since the metal-containing material is melted on the carbonaceous material layer, the phenomenon that the melted metal enters fine gaps in the hearth refractory can be avoided, and damage of the hearth refractory due to such a phenomenon can be completely prevented.

Moreover, according to the invention, the projection height of the denting roll is set to such a dimension to allow a formed recess to reach at least the surface of the carbonaceous material layer and preferably a deeper level beyond it. Therefore, the shape of the recess can be maintained with higher certainty, enabling the melted metal and the melted slag to be more reliably aggregated into the recesses.

Still further, according to the invention, when forming the recess, a portion of the raw material layer around the recess is depressed at the same time as or before pressing of the projection against the surface of the raw material layer. Therefore, the surface of the raw material layer around the recess is prevented from heaping at the moment when the recess is formed, and the recess can be formed in the intended shape. Hence, the shape of the recess can be controlled in a more satisfactory manner. This results in an additional advantage that variation in shape of the agglomerated metal and slag is reduced and easiness in handling them in subsequent steps is improved.

What is claimed is:

1. A method of charging a raw material and a carbonaceous material into a moving hearth furnace comprising:

charging said carbonaceous material onto a flat moving hearth of said moving hearth furnace to form a carbonaceous material layer thereon in a manner which prevents molten metal from directly contacting the moving hearth;

charging said raw material or a mixture of said raw material and a carbonaceous material onto said carbonaceous material layer to form a raw material layer on said carbonaceous material; and forming a plurality of metal and slag receiving/holding recesses in a scattered pattern on a surface of said carbonaceous material layer.

2. The method defined claim 1, wherein said raw material mainly comprises a powdery and/or granular metal-containing material.

3. The method defined in claim 1, wherein said carbonaceous material comprises a powdery and/or granular solid reductant.

4. The method defined in claim 1, further comprising heating said layers for reduction and melting during movement of said moving hearth within a heating furnace of said moving hearth furnace, thereby producing a reduced metal.

5. A method of charging a raw material and a carbonaceous material into a moving hearth furnace comprising:

charging said carbonaceous material onto a moving hearth of said moving hearth furnace to form a carbonaceous material layer thereon;

charging said raw material or a mixture of said raw material and a carbonaceous material onto said carbonaceous material layer to form a raw material layer on said carbonaceous material; and forming a plurality of recesses on a surface of said carbonaceous material layer, wherein said recesses are formed by pressing a projection against said raw material layer.

6. The method defined in claim 5, wherein, in said step of pressing a projection against said raw material layer, a tip end portion of said projection is pressed to a level lower than a surface level of said carbonaceous material layer, thereby forming a recess that extends through said raw material layer into said carbonaceous material layer.

7. The method defined in claim 6, wherein a portion of said raw material layer corresponding to the recess formed in the surface of said carbonaceous material layer is pressed at the same time as or before pressing by said projection.

8. The method defined in claim 6, wherein said projection pressing steps performed using a denting roll having a plurality of projections.

9. The method defined in claim 8, wherein before pressing the projection of said denting roll, said raw material layer is pressed in advance by an outer circumferential portion of said denting roll other than the projections.

10. The method defined in claim 5, wherein a portion of said raw material layer corresponding to the recess formed in the surface of said carbonaceous material layer is pressed at the same time as or before pressing by said projection.

11. An apparatus for charging a raw material and a carbonaceous material into a moving hearth furnace comprising:

carbonaceous material charger for charging a carbonaceous material onto a moving hearth of said moving hearth furnace to form a carbonaceous material layer;

raw material charger for charging raw material or a mixture of said raw material and a carbonaceous material on said carbonaceous material layer formed on said moving hearth to form a raw material layer thereon; and a denting device provided downstream of said raw material charger and which is capable of forming a plurality of recesses on a surface of said carbonaceous material layer lying under said raw material layer.

12. The apparatus defined in claim 11, wherein said raw material mainly comprises a powdery and/or granular metal-containing material.

13. The apparatus defined in claim 11, wherein said carbonaceous material comprises a powdery and/or granular solid reductant.

14. The apparatus defined in claim 11, wherein said denting device is a denting roll having a plurality of projections.

* * * * *